US007168783B2

(12) United States Patent
Naito

(10) Patent No.: US 7,168,783 B2
(45) Date of Patent: Jan. 30, 2007

(54) APPARATUS AND METHOD OF CONTROLLING A PRINTHEAD OF A PRINTING APPARATUS

(75) Inventor: Hisatsugu Naito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 209 days.

(21) Appl. No.: 10/645,227

(22) Filed: Aug. 21, 2003

(65) Prior Publication Data

US 2004/0119778 A1 Jun. 24, 2004

(30) Foreign Application Priority Data

Aug. 21, 2002 (JP) ..... 2002-240455

(51) Int. Cl.
*B41J 29/393* (2006.01)
*B41J 23/00* (2006.01)

(52) U.S. Cl. ..... 347/37; 347/19

(58) Field of Classification Search ..... 347/19, 347/37; 400/283; 318/615–617, 685
See application file for complete search history.

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,558,333 A 12/1985 Sugitani et al.
4,723,129 A 2/1988 Endo et al.
4,740,796 A 4/1988 Endo et al.
2003/0043228 A1* 3/2003 Igarashi ..... 347/37

* cited by examiner

*Primary Examiner*—Julian D. Huffman
(74) *Attorney, Agent, or Firm*—Morgan & Finnegan, LLP

(57) ABSTRACT

In an ink-jet printer in which a carrier is servo-controlled using an encoder, speed information at the start of movement is estimated to perform stable servo control without any influence of an incorrect speed owing to vibrations or the like at the start of movement. For this purpose, in servo-controlling the carrier by using a DC motor on the basis of position information obtained from the encoder, not a detected speed obtained from the encoder, but an ideal speed or an estimated speed calculated by multiplying an ideal speed by a predetermined ratio is used as speed information for servo control of the carrier until the carrier moves in an arbitrary speed estimation region after the start of movement.

15 Claims, 9 Drawing Sheets

APPARATUS AND METHOD OF CONTROLLING A PRINTHEAD OF A PRINTING APPARATUS

FIELD OF THE INVENTION

The present invention relates to a printing apparatus which prints by servo-controlling, e.g., a DC servomotor serially scanning a carrier supporting a printhead while relatively moving the printhead on a printing medium, and a DC motor servo control method.

BACKGROUND OF THE INVENTION

Ink-jet printers which print by injecting ink supplied to a printhead toward a printing medium (printing sheet) by heating or vibrations are the mainstream among current serial printers because of high image quality and low cost.

Such ink-jet printer uses a stepping motor and servo-controlled DC servomotor in order to serially scan a carrier which supports an ink-jet head serving as a printhead.

Recently, in order to reduce printing noise and increase the printing resolution, many printers adopt a DC servomotor which supports a magnetic or optical encoder so as to scan it together with a carrier and undergoes servo (feedback) control so as to converge the carrier to a target speed or position on the basis of speed information or position information obtained from the encoder.

In servo-controlling a carrier by using a DC motor, PID control is generally employed.

PID control is a control method of determining a target position at each time and a target speed at each time, calculating a proportional element, integral element, and differential element from the deviations between the target position and target speed at each time, and speed information and position information actually obtained from the encoder in accordance with the time schedule, changing energy (e.g., PWM-controlled DC current value) to be applied to the DC servomotor, and smoothly driving the carrier with small noise.

Servo control has conventionally been executed by always referring to speed information detected by an encoder. When the carrier starts operation, the carrier has rarely gained a speed yet, but a speed (speed higher than an actual one) different from an actual carrier speed may be instantaneously detected due to carrier vibrations or the like.

In this case, speed information much higher than the target speed is referred to in servo control immediately after the start of operation, and the output is narrowed down in the next servo control. The output hardly increases, and a long time is taken until energy for actually activating the carrier. In the worst case, an error determination condition is met, and an error stop occurs.

SUMMARY OF THE INVENTION

The present invention has been made to overcome the conventional drawbacks, and has as its object to provide a printing apparatus capable of smoothly driving a carrier by preventing a servo control disturbance and error stop owing to detection of incorrect speed information until the carrier moves by a predetermined amount immediately after the start of operation in, e.g., servo-controlling the carrier by a DC motor, and a control method therefor.

To solve the above problems and achieve the above object, according to the present invention, a printing apparatus which prints by relatively moving a printhead on a printing medium comprises control means for feedback-controlling a carrier supporting the printhead by using an ideal speed and an ideal position, carrier position detection means for detecting carrier position information to be referred to by the control means, carrier speed detection means for detecting carrier speed information to be referred to by the control means, and speed estimation means for calculating an estimated speed at a predetermined ratio by using the ideal speed referred to by the control means.

According to the present invention, a method of controlling a printing apparatus which prints by relatively moving a printhead on a printing medium comprises a control step of feedback-controlling a carrier supporting the printhead by using a predetermined (e.g., ideal) speed and a predetermined (e.g., ideal) position, a carrier position detection step of detecting carrier position information to be referred to in the control step, a carrier speed detection step of detecting carrier speed information to be referred to in the control step, and a speed estimation step of calculating an estimated speed at a predetermined ratio by using the predetermined (e.g, ideal) speed referred to in the control step.

Preferably in the printing apparatus and control method therefor, the control means (step) does not refer to, as speed information used for the feedback control, the carrier speed information detected by the carrier speed detection means (step), and refers to the ideal speed or the estimated speed until the carrier moves by a predetermined amount after start of operation.

Preferably in the printing apparatus and control method therefor, the control means (step) does not refer to, as speed information used for the feedback control, the carrier speed information detected by the carrier speed detection means (step), and refers to the estimated speed as 0 until the carrier moves by a predetermined amount after start of operation.

Preferably in the printing apparatus and control method therefor, an independent value can be selected for each ideal speed as the predetermined ratio used for calculation by the speed estimation means (step).

Preferably in the printing apparatus and control method therefor, the predetermined ratio used for calculation by the speed estimation means (step) is set to a value which makes a difference between the estimated speed or the carrier speed information and the ideal speed fall within a predetermined range.

According to the present invention, a printing apparatus which prints by relatively moving a carrier supporting a printhead on a printing medium, comprises encoder means for detecting carrier speed information and carrier position information, control means for feedback controlling the carrier by using a predetermined speed profile and storing means for storing speed infromation corresponding to moving amount of the carrier, wherein said control means controls the carrier by using the speed information stored in the storing means without referring the speed information detected by the encoder means as speed information to be used in feedback control until the carrier moves in a predetermined moving amount from the start of movement, and controls the carrier by using the speed information detected by the encoder means after the moving amount of the carrier becomes greater than the predetermined moving amount.

The present invention can also be applied to the form of a program for causing the computer of the printing apparatus to execute any of the printing methods, or the form of a computer-readable storage medium which stores the program.

As described above, according to the present invention, in servo-controlling a carrier by using a DC motor on the basis of position information obtained from an encoder, not a detected speed obtained from the encoder, but an ideal speed or an estimated speed calculated by multiplying an ideal speed by a predetermined ratio is used as speed information for servo control of the carrier until the carrier moves in an arbitrary speed estimation region (several slits) after the start of movement. The carrier can be smoothly driven without any servo control disturbance caused by detection of an incorrect speed at the start of activating the carrier or an error stop upon satisfying an error determination condition.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Preferred embodiments according to the present invention will be described in detail below with reference to the accompanying drawings.

The following embodiments will exemplify a case wherein an ink-jet printer is applied to as a printing apparatus according to the present invention. This is an example of the implementation means of the present invention, and the present invention can be applied to changes and modifications of the following embodiments within the spirit and scope of the invention.

[First Embodiment]

Figure 1:
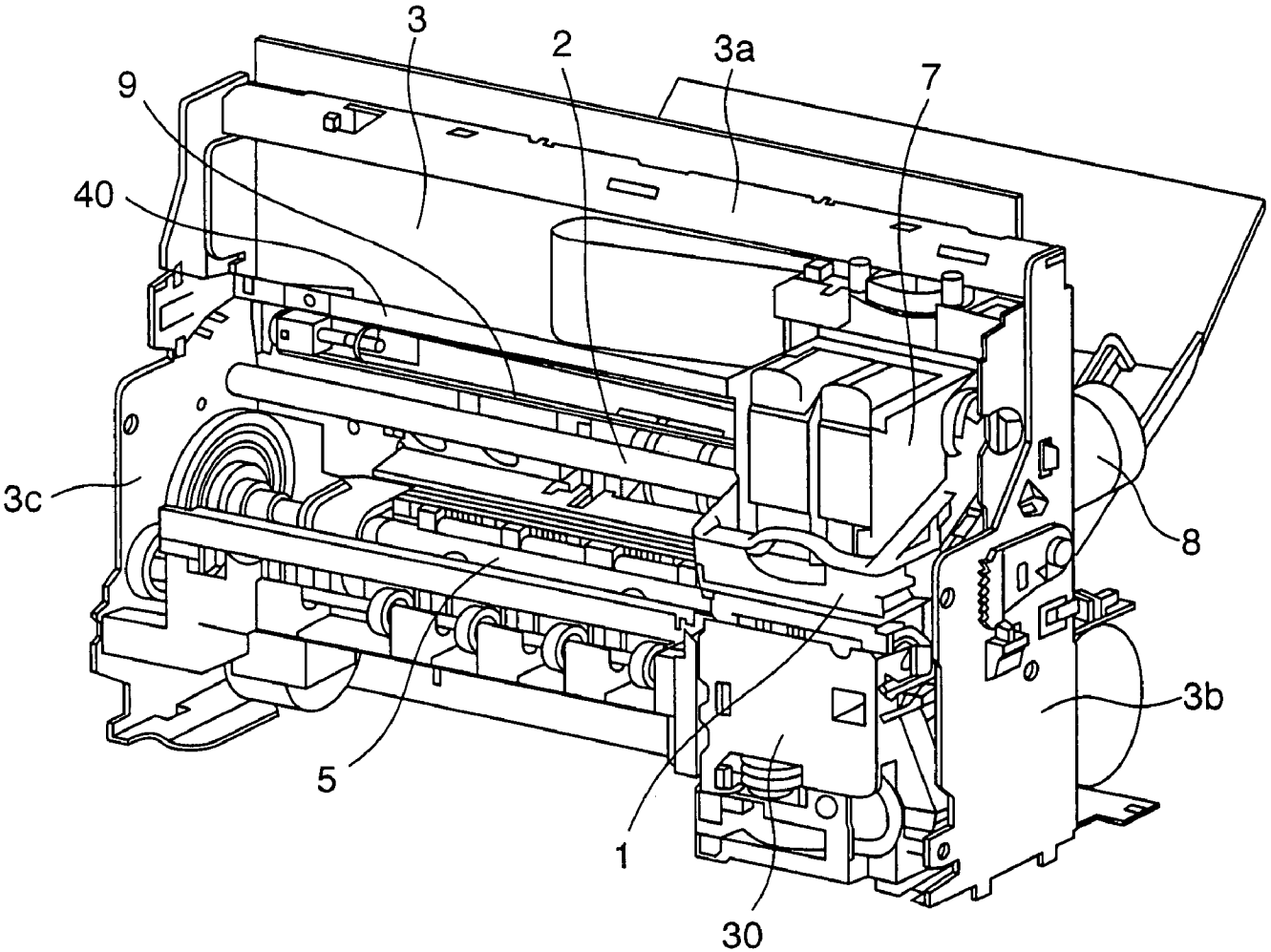
FIG. 1 is a perspective view showing the mechanical structure of an ink-jet printer according to an embodiment of the present invention.

FIG. 1 is a perspective view showing the mechanical structure of an ink-jet printer which is applied as an embodiment according to the present invention.

In FIG. 1, a carrier 1 is reciprocally axially supported by a guide shaft 2 and guide rail 3*a* so as to face a line feed (LF) roller 5 and platen (not shown) held by a chassis 3. A printhead 7 is detachably mounted on the carrier 1, and reciprocally moves along the guide shaft 2 by a carrier motor 8 via a belt 9.

In printing, the carrier 1 is accelerated in the main scanning direction from the stopped state, and then moves at a predetermined speed. At the predetermined speed, the heaters of nozzles in the printhead 7 are individually driven in accordance with printing data sent into the printer, and ink is injected from the nozzles by the force of formed bubbles to print on a printing sheet.

At the end of printing driving of one line, the carrier 1 is decelerated and stops, and the printing sheet is fed in the sub-scanning direction by the LF roller 5 driven by a sheet supply motor (sheet supply operation). After that, carrier scanning and sheet supply operation are repeated to print on the printing sheet.

As the carrier motor 8, a stepping motor, servo-controlled DC motor, or the like is used. A servo-controlled DC motor is frequently used in terms of noise reduction and an increase in printing speed. Since a DC motor is adopted in FIG. 1, an encoder scale 40 having a slit is provided.

The printer is constituted by attaching components to the chassis 3 formed from a metal plate or the like. Parts of the chassis form the guide rail 3*a*, a right wall 3*b*, and a left wall 3*c*. Unlike the use of a stepping motor as the carrier motor 8, the carrier 1 is generally driven in a predetermined direction (in FIG. 1, toward the right wall 3*b*) in order to determine the reference position of the carrier 1. It is detected that the carrier 1 collides against the right wall 3*b* and does not move for a predetermined time, and then the right wall 3*b* is determined as a reference position (=0). Thereafter, the position of the carrier 1 is always managed by a position (distance) from the right wall 3*b*. This operation is performed only once at the start of initializing the printer mechanism upon power-on and is not done subsequently (during power-on) because the position slightly varies by frequent operation.

Figure 2:
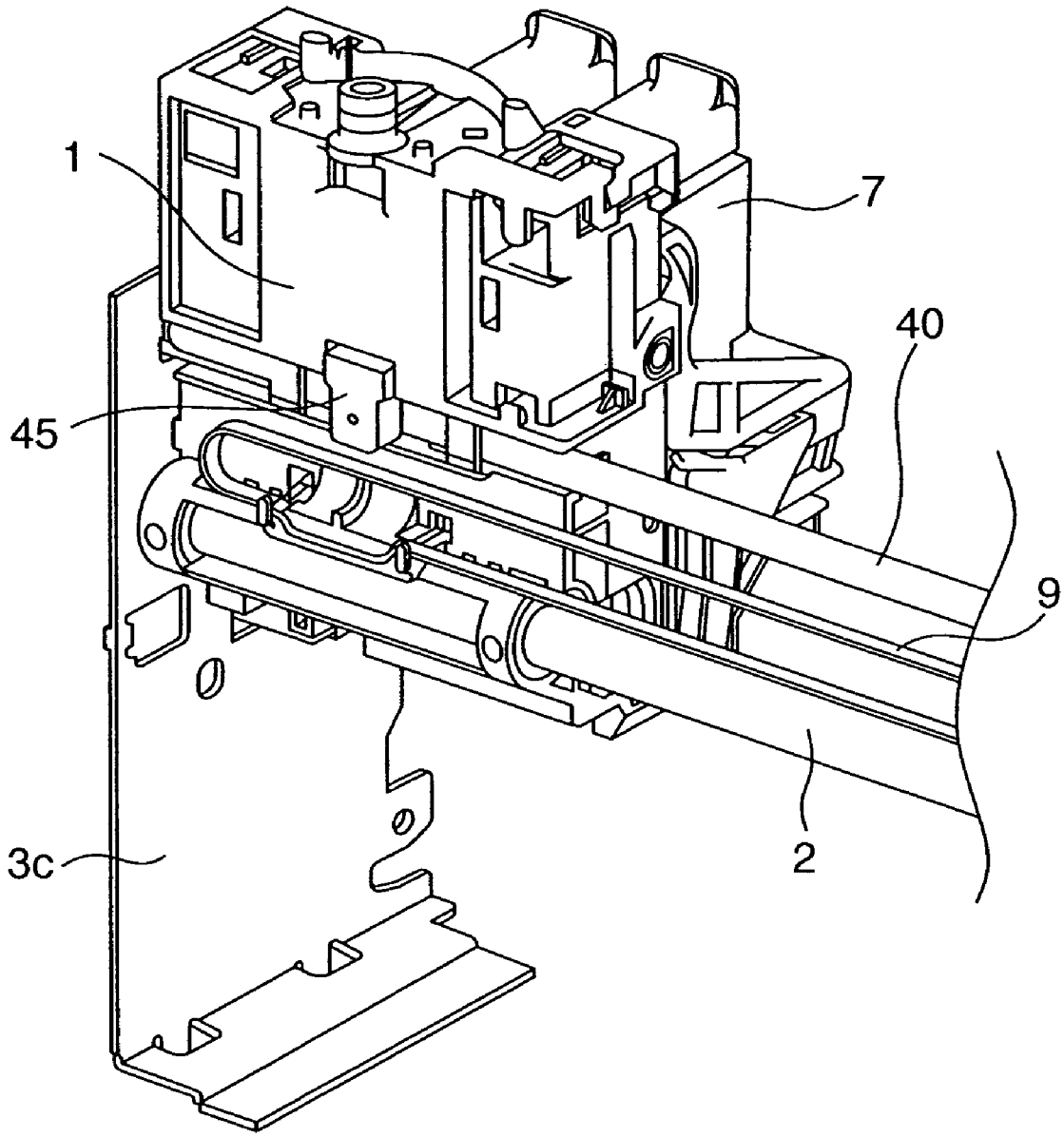
FIG. 2 is a perspective view showing in detail the carrier driving mechanism of the ink-jet printer according to the embodiment of the present invention.

FIG. 2 is a perspective view showing the carrier driving mechanism of the ink-jet printer according to the first embodiment.

The guide shaft 2 is fixed to the right wall 3*b* and left wall 3*c* of the chassis 3, and guides reciprocation of the carrier 1.

The belt 9 is coupled to the carrier motor (DC motor) 8 fixed to the chassis 3, and is fixed to the carrier 1. The belt 9 converts rotation of the carrier motor 8 into reciprocation to move the carrier 1. The encoder scale 40 has marks at predetermined pitches, and is held by the chassis 3 at a predetermined tension.

The encoder scale 40 can accurately acquire the position of the carrier 1 by detecting marks formed at equal intervals of 300 lpi (lines per inch: 25.4 mm/300=84.6 μm) by an encoder sensor 45 fixed to the carrier 1. The detection method of the encoder sensor is optical or magnetic. In scanning the carrier 1, the speed of the carrier 1 can be calculated from the detection time interval between the marks of the linear encoder scale 40.

Figure 3:
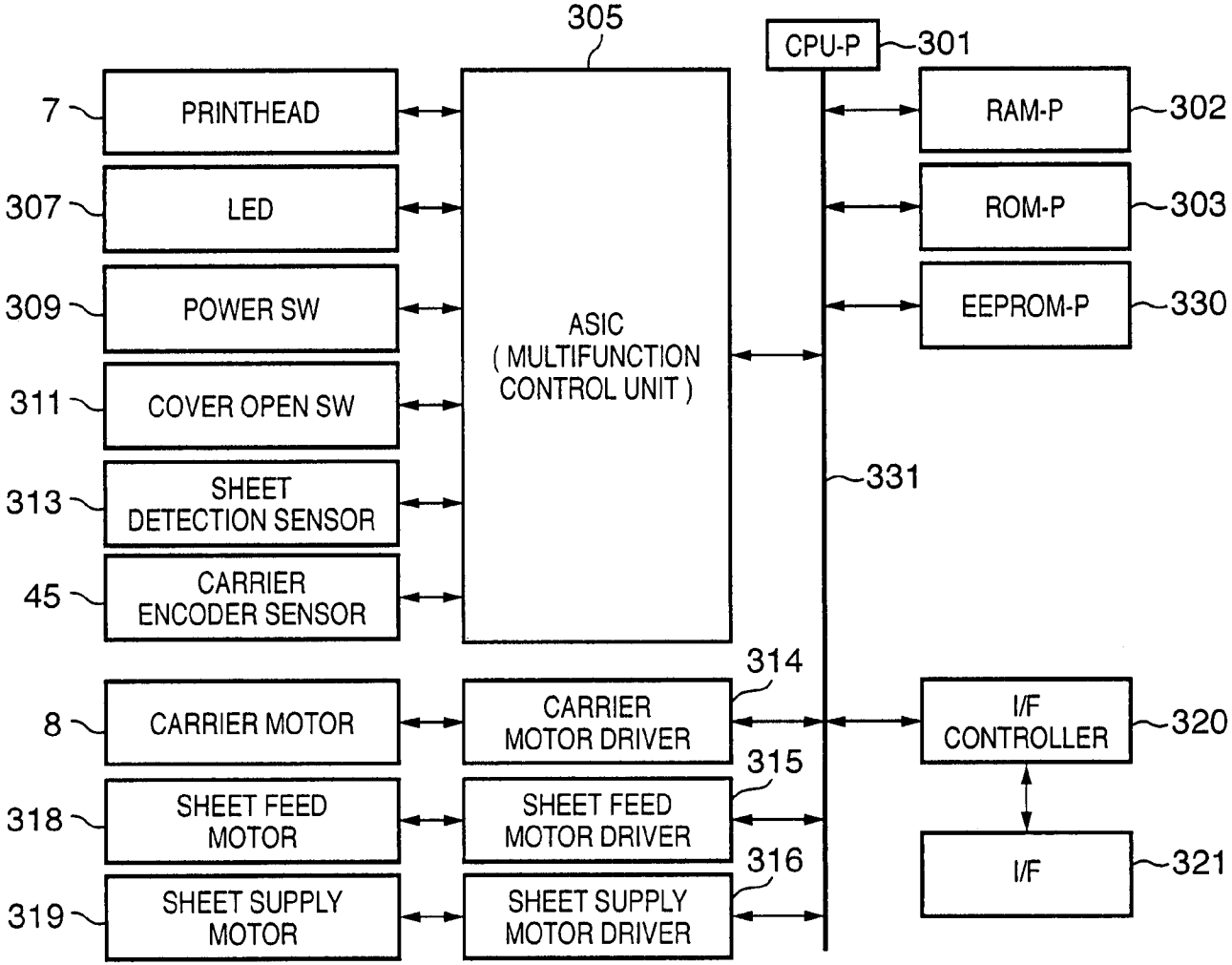
FIG. 3 is a block diagram showing the electrical arrangement of the ink-jet printer according to the embodiment of the present invention.

FIG. 3 is a block diagram showing the electrical arrangement of the ink-jet printer.

In FIG. 3, reference numeral 301 denotes a CPU-P (Central Processing Unit) which controls the overall apparatus and can communicate via a CPU-BUS 331 with a RAM-P 302, ROM-P 303, EEPROM-P 330, ASIC (multi-function control unit) 305, motor drivers 314 to 316, and I/F controller 320.

In accordance with a control program in the ROM-P 303, the CPU-P 301 controls rotation of three motors (the carrier motor 8, a sheet supply motor 318, and a sheet feed motor 319) via the motor drivers 314 to 316 on the basis of various command signals input via the multifunction control unit 305 from two sensors (the carrier encoder sensor 45 and a sheet insertion sensor 313) and various switches 309 to 311 attached to the control panel and a printing command which is read out from the I/F controller 320 and sent from the host to an interface 321. Further, the CPU-P 301 outputs printing data to the printhead (ink-jet head) 7 via the ASIC 305 and transfers the printing data to the printhead 7 to perform printing control corresponding to a printing command.

The RAM-P (printer RAM: temporary memory) 302 is used as a reception buffer for temporarily storing mapped data for printing and data (printing command and printing data) received from the host, a work area for storing necessary information such as a printing speed, a work area for the CPU-P 301, and the like.

The ROM-P (printer ROM: read-only memory) 303 stores a printing control program which is executed by the CPU-P 301 to transfer printing data to the printhead 7 and cause the printhead 7 to print, a program for controlling the carrier motor 8, sheet supply motor 318, and sheet feed motor 319, a printer emulation program, a printing font, and the like.

The multifunction control unit 305 has a function of detecting the printhead 7, a function of turning on/off and flickering a power LED 307, a function of detecting the power S/W 309 and cover open S/W 311, and a function of detecting the sheet insertion sensor 313.

The motor drivers 314 to 316 drive and control the motors 8, 318, and 319.

The motors 8, 318, and 319 are connected to the motor drivers 314 to 316, and driven and controlled by the motor drivers 314 to 316 in accordance with an instruction from the CPU-P 301.

As the carrier motor 8, a DC servomotor is used for servo control to be described later. As the sheet supply motor 318 and sheet feed motor 319, stepping motors which can be easily controlled by the CPU-P 301 are exploited.

The I/F controller 320 is a bidirectional interface which is connected to the host computer via the I/F 321, receives a printing command and printing data from the host computer, and transmits error information on the printer side or the like. Various interfaces such as a Centronics interface and USB interface are available.

The EEPROM-P 330 is a nonvolatile random access memory for storing the number of prints, the number of printing discharge dots, the ink tank exchange count, the printhead exchange count, the user instruction cleaning operation execution count, and the like. The EEPROM-P 330 holds written contents even upon power-off.

Figure 4:
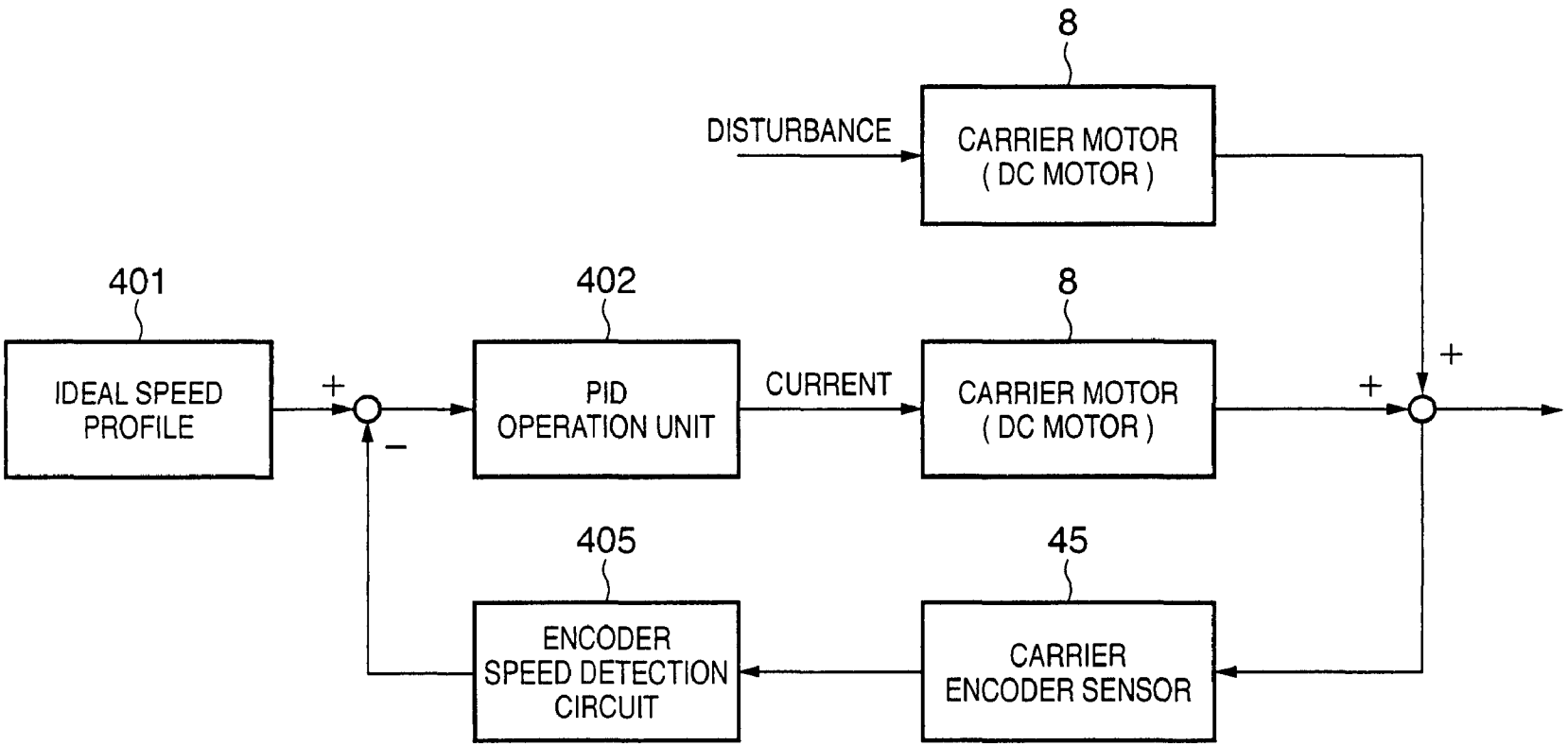
FIG. 4 is a block diagram for explaining servo control of the carrier of the ink-jet printer according to the embodiment.

FIG. 4 is a block diagram for explaining the carrier scanning speed control system of the ink-jet printer.

The carrier motor 8 (DC motor) is controlled by a method called PID control.

The procedures of PID control will be explained.

A target speed to be supplied to the carrier 1 is given as an "ideal speed (profile)" 401. The "ideal speed (profile)" generally takes a form of increasing (accelerating) the speed at a predetermined ratio, converting the speed to a target speed (constant speed), and decreasing (decelerating) the speed at a predetermined ratio from the vicinity of a target stop position.

An encoder speed detection circuit 405 calculates the current "speed" of the carrier 1 by inputting an output signal from the carrier encoder sensor 45 to the ASIC 305 of the printer, and counting output signals by the internal timer of the ASIC 305.

Figure 5:
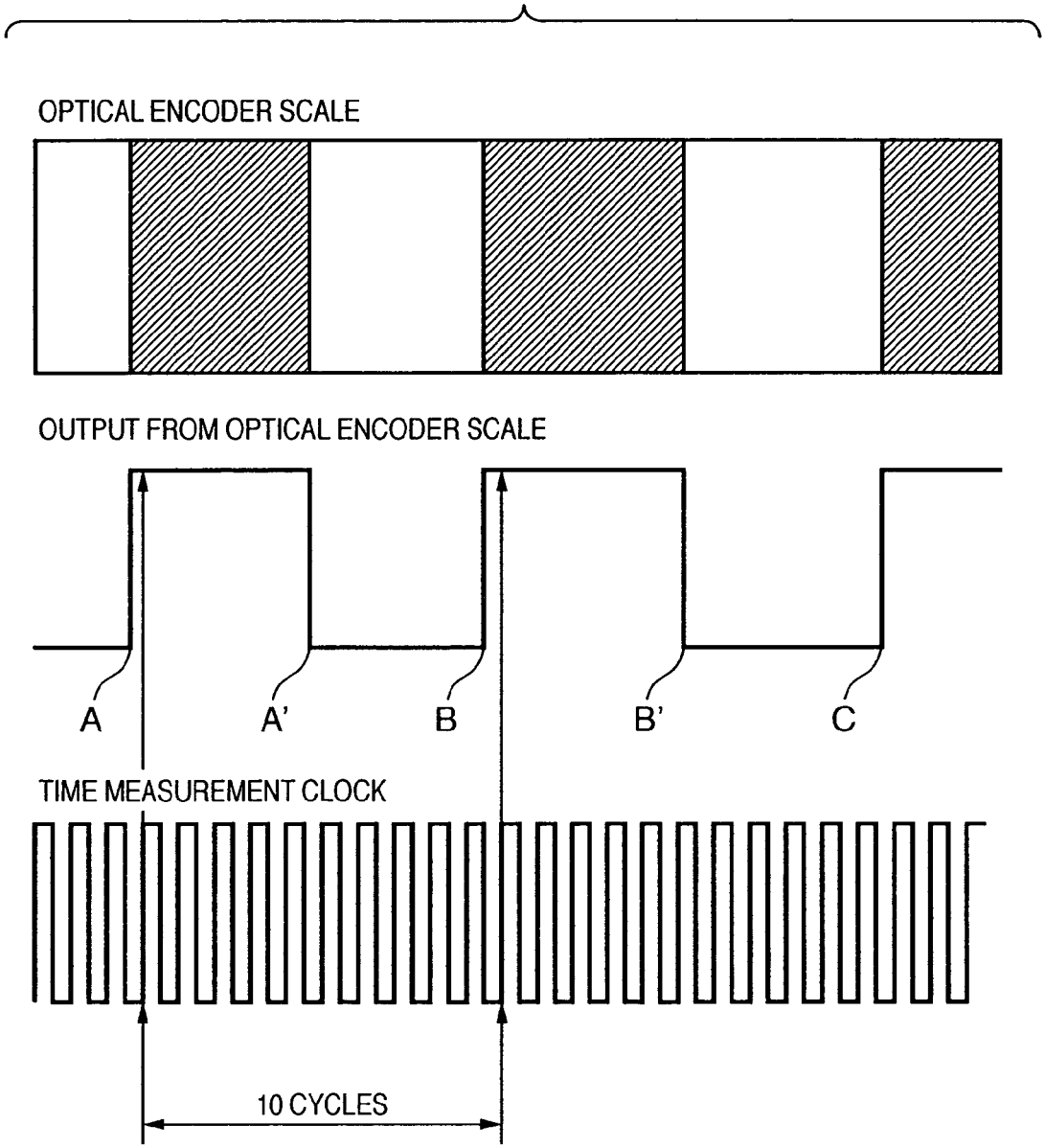
FIG. 5 is a schematic view for explaining the relationship between the optical encoder of the ink-jet printer and speed information according to the embodiment.

More specifically, operation of counting the number of clocks between slits A and B in FIG. 5 and saving the count in the register of the ASIC 305 is always repeated. This register value is read, and the actual physical distance between slits (for 300-lpi slits, (25.4 mm÷300)) is divided by the number of clocks×the clock time, thereby calculating an instantaneous speed.

A numerical value calculated by subtracting the "detected speed (calculated from the number of clocks)" from the "ideal speed" is sent to a "PID operation unit" 402 as a "speed error" by which the speed is lower than the target speed. Energy to be applied to the carrier motor 8 at this time is calculated by a method called "PID operation". The calculated result (PWM value) is set in the register of the ASIC 305. By changing the pulse width of an application voltage with a constant motor application voltage (to be referred to as "PWM (Pulse Width Modulation) control" hereinafter), the duty of the application voltage is changed to adjust the current value. Energy to be applied to the DC motor is adjusted to control the speed. The control result is reflected as the output value (speed information) of the carrier encoder sensor 45 together with a disturbance factor supplied to the carrier motor 8, and fed back to the PID operation unit 402.

FIG. 5 is a schematic view for explaining the relationship between the optical encoder scale of the ink-jet printer and speed information.

The optical encoder scale 40 is formed by printing a pattern of black and transparent portions, as shown in FIG. 5. When the carrier 1 moves, the scale 40 is read by the encoder sensor 45 to obtain a pattern in which the output waveform repeats high level and low level in accordance with the position of the carrier 1, as shown in FIG. 5. Pieces of output waveform information are counted by the basic clocks of the ASIC 305 or clocks prepared by multiplying/driving the basic clocks, thereby obtaining the time taken from point A to point B. The distance (between a black portion and transparent portion of the encoder scale) is divided by the obtained time to calculate the average speed during movement.

Figure 6:
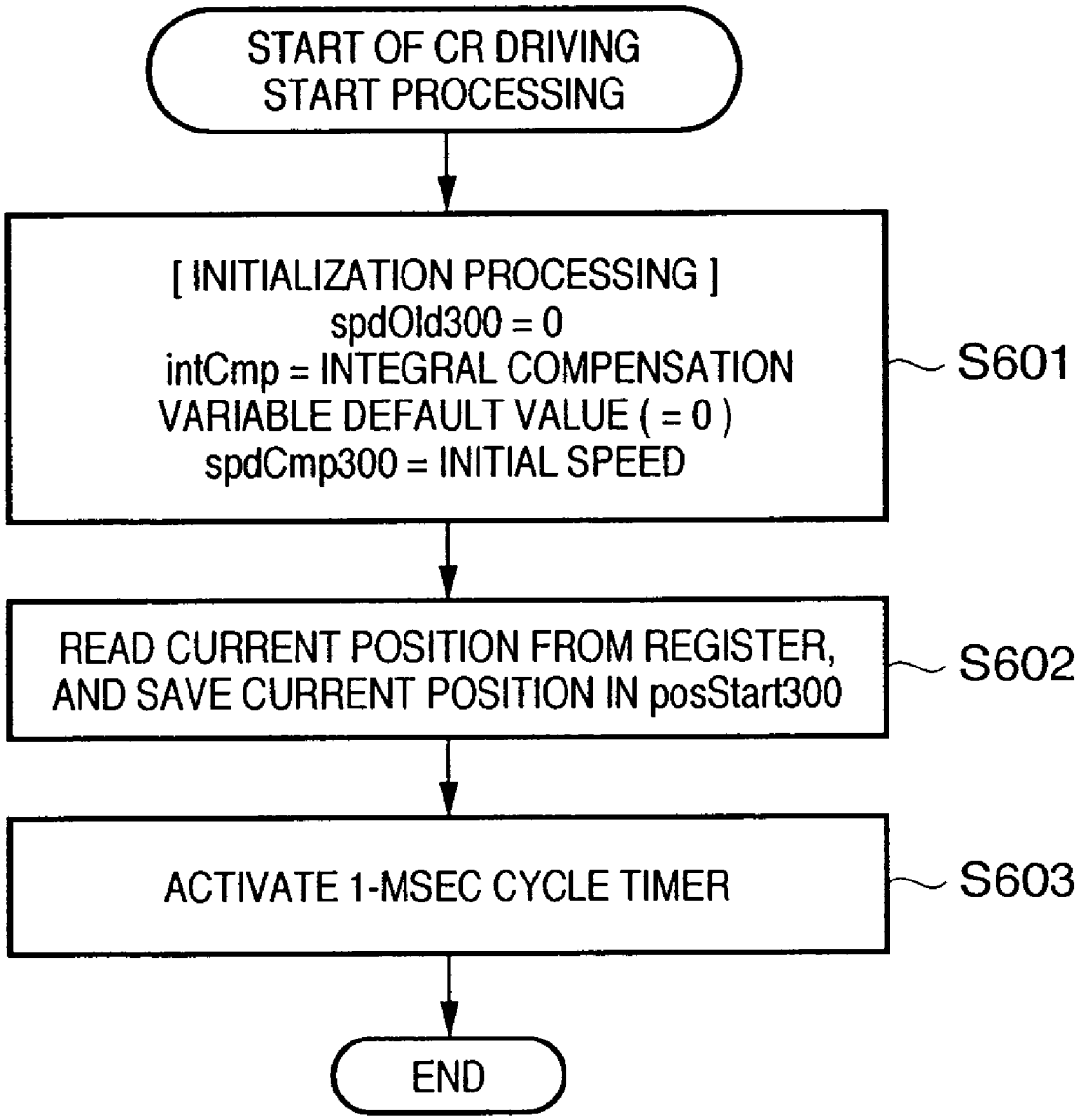
FIG. 6 is a flow chart showing carrier driving start processing of the ink-jet printer according to the first embodiment of the present invention.

FIG. 6 is a flow chart showing carrier driving start processing of the ink-jet printer according to the first embodiment of the present invention.

In S601 of FIG. 6, as work initialization processing in the RAM necessary for one driving, a previously detected speed spdOld and integral compensation variable intCmp are set to default values (zero), and a low-pass filter operation value spdCmp300 is set to an initial speed. In S602, position information before the start of driving is read out from the register of the ASIC 305, and saved in a work area posStart300 in the RAM.

In S603, servo control timer processing activated during a 1-msec cycle starts.

Figure 7:
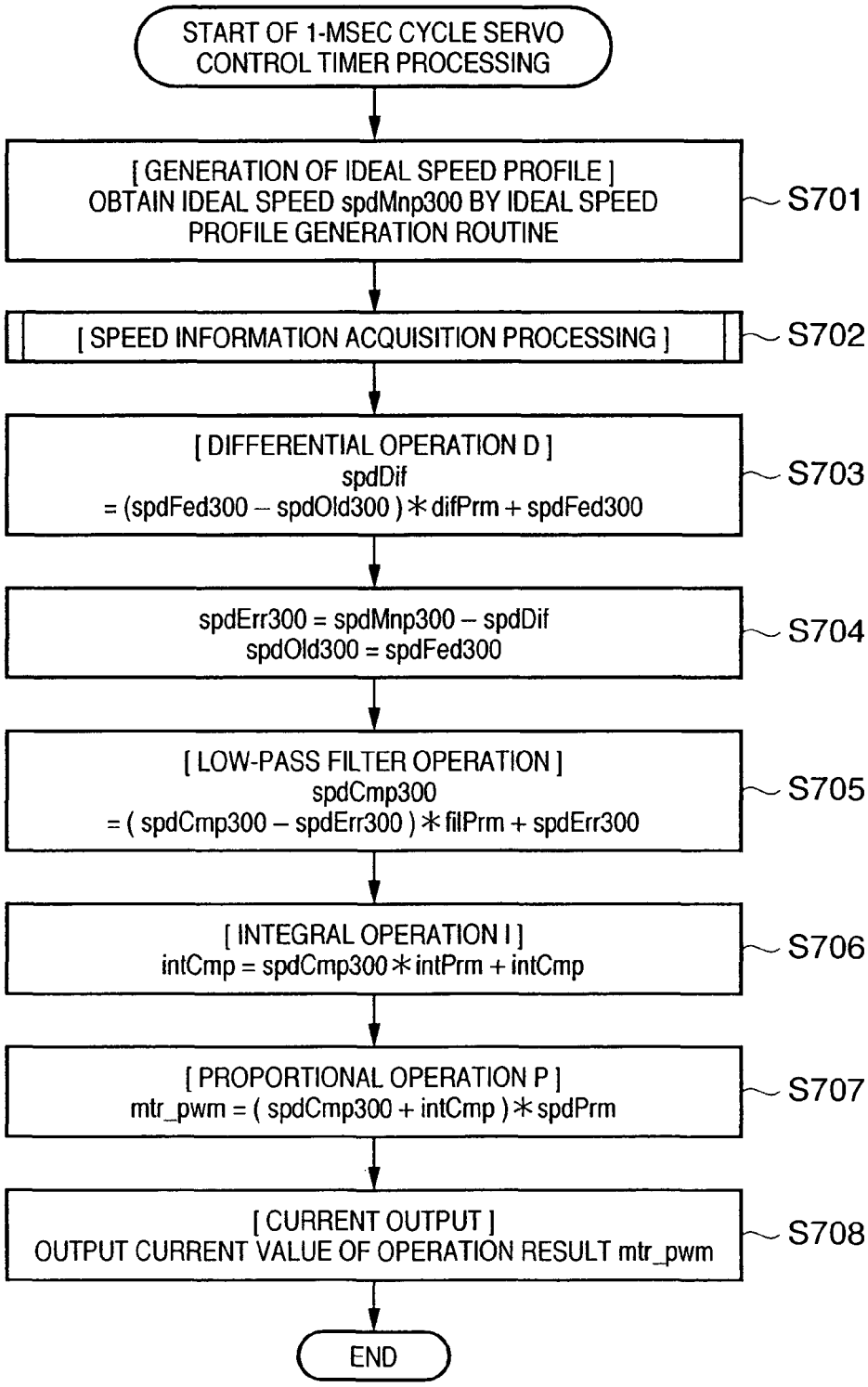
FIG. 7 is a flow chart showing servo processing by a 1-msec cycle timer for driving the carrier of the ink-jet printer according to the first embodiment of the present invention.

FIG. 7 is a flow chart showing servo control processing by a 1-msec cycle timer for driving the carrier of the ink-jet printer according to the first embodiment of the present invention.

In S701 of FIG. 7, an ideal speed spdMnp300 at the current time is obtained from an ideal speed profile. More specifically, a speed at the current time is obtained for an ideal speed represented by the thick line in FIG. 9A. In S702, actual speed information is acquired (speed information acquisition processing in FIG. 8 will be described later).

In S703, differential operation D in PID control is performed (spdDif=(spdFed300−spdOld300)*difPrm+spdFed300) where spdFed300 is the currently detected speed by the encoder, difPrm is the differential gain, and spdOld300 is the previously detected speed.

In S704, a speed error SpdErr300 is calculated from the speed (spdDif) that is value as a result of the differential operation D and ideal speed (spdMnp300) (spdErr300=spdMnp300−spdDif). Further, the previously detected speed is updated (spdOld300=spdFed300).

In S705, low-pass filter operation is done using a filter gain constant filPrm in order to prevent high-frequency noise. A low-pass filter operation value spdCmp300 is given by (spdCmp300=(spdCmp300−spdErr300)*filPrm+spdErr300).

In S706, integral operation I in PID control is performed. An integral compensation variable intCmp is the sum of the product of the low-pass filter operation value spdCmp300 and integral gain intPrm and a previous integral compensation variable intCmp (intCmp=spdCmp300*intPrm+intCmp).

In S707, proportional operation P in PID control is executed for the low-pass filter operation value spdCmp300 obtained in S705 and the integral compensation variable intCmp obtained in S706 after integral operation. A proportional gain spdPrm is multiplied to obtain mtr_pwm (mtr_pwm=(spdCmp300+intCmp)*spdPrm).

In S708, a PWM value for driving the DC motor on the basis of the operation result mtr_pwm is output to the ASIC 305 to supply a driving current value to the carrier motor 8.

By repeating this processing every 1 msec, feedback control based on PID control is done to drive and control the carrier 1.

Figure 8:
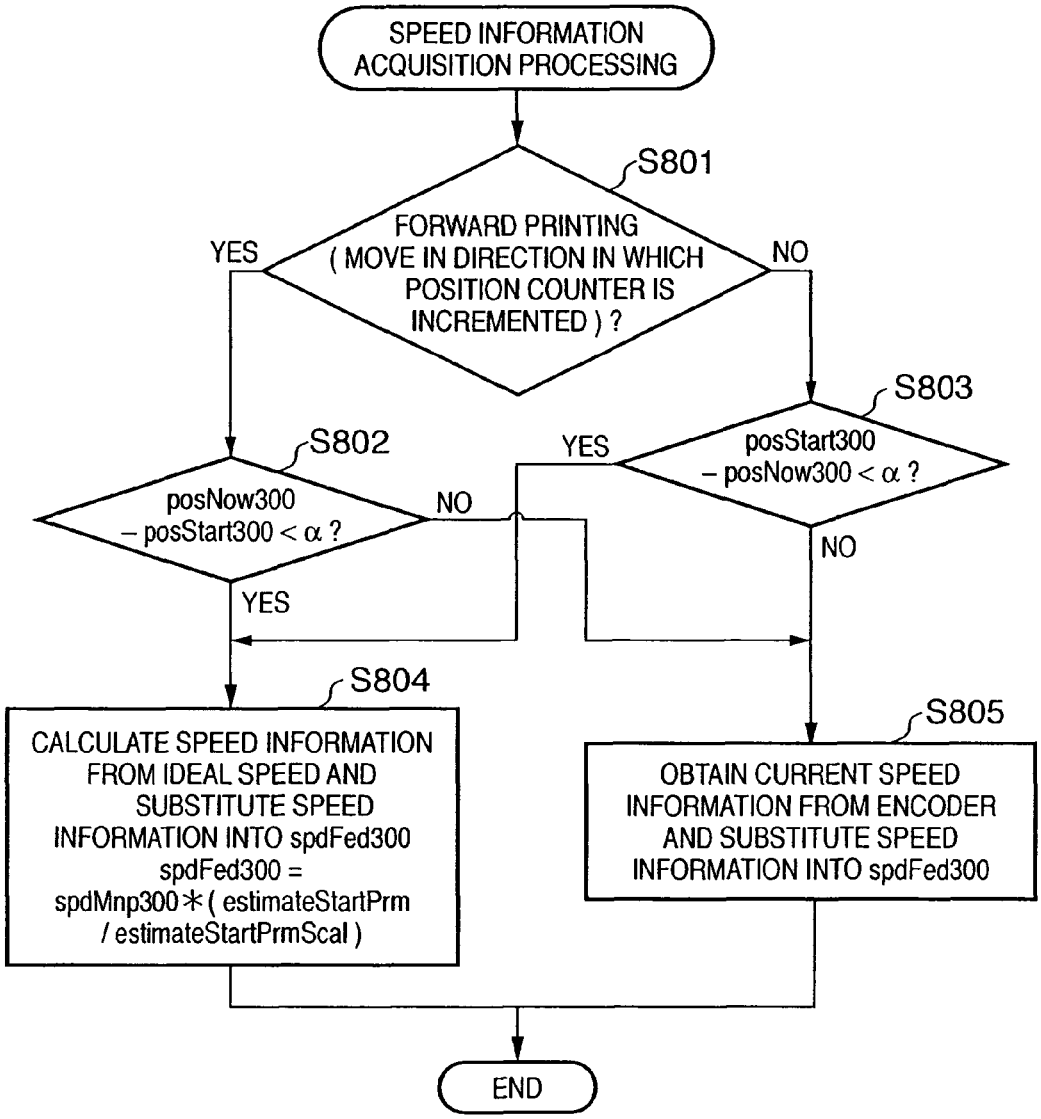
FIG. 8 is a flow chart showing speed information acquisition processing of the ink-jet printer according to the first embodiment of the present invention.

FIG. 8 is a flow chart showing speed information acquisition processing of the ink-jet printer according to the first embodiment of the present invention. FIG. 8 shows details of speed information acquisition processing in S702 of FIG. 7.

In S801 of FIG. 8, the current printing (and moving) direction is determined. For a direction in which the position information counter of the encoder is incremented (in the first embodiment, forward printing), the flow advances to S802; for return printing (direction in which the position information counter of the encoder is decremented), to S803.

In S802, a position posStart300 saved at the start of driving is subtracted from a current position posNow300. If the difference is smaller than a given threshold α (corresponding to two to four slits) (the carrier moves less than α slits after the start of movement), an accurate speed may not be detected from the encoder owing to activation vibrations or the like, and the flow advances to S804. An estimated speed is calculated as a spdFed300 obtained by multiplying an ideal speed spdMnp300 at this time by a given ratio (estimateStartPrm/etimeteStartPrmScal) (spdFed300=spdMnp300*(estimateStartPrm/etimeteStartPrmScal)).

To the contrary, in S802, the position posStart300 saved at the start of driving is subtracted from the current position posNow300. If the carrier moves more than the threshold α (corresponding to two to four slits) (the carrier moves more than α slits after the start of movement), in S805, speed information obtained by the encoder accurately reflects an actual speed, and a detected speed based on encoder information which the ASIC 305 has is set to speed information spdFed300.

Also in S803, the same determination processing is done. Unlike S802, the current position posNow300 is subtracted from the position posStart300 saved at the start of driving. If the difference is smaller than the threshold α (corresponding to two to four slits) (the carrier moves less than α slits after the start of movement), an accurate speed may not be detected from the encoder owing to activation vibrations or the like, and the flow advances to S804. In this manner, a term preceding or succeeding to a subtraction term changes depending on the moving direction.

The ratio (estimateStartPrm/etimeteStartPrmScal) for multiplying the ideal speed spdMnp300 by a predetermined ratio is set to a value such as 2/3 (estimateStartPrm=2, etimeteStartPrmScal=3), or 4/7 (estimateStartPrm=4, etimeteStartPrmScal=7) so as to generally set the ratio to 1 or less. A speed which is a fraction of the ideal speed is estimated. These ratios are independently switched for each target speed (constant speed to be reached).

Figure 9A:
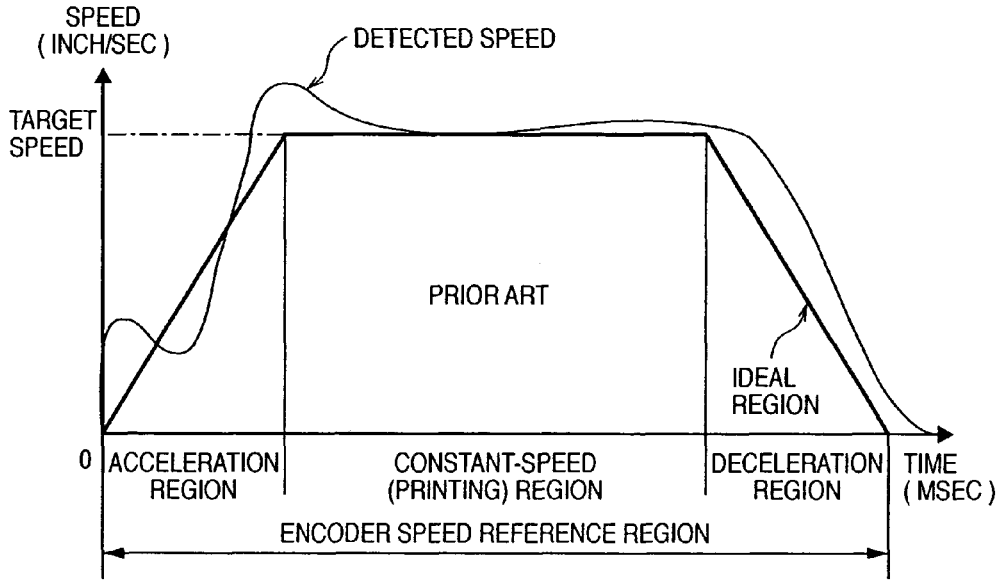
FIG. 9A is a graph showing the relationship between a target speed and a detected speed in the prior art.
Figure 9B:
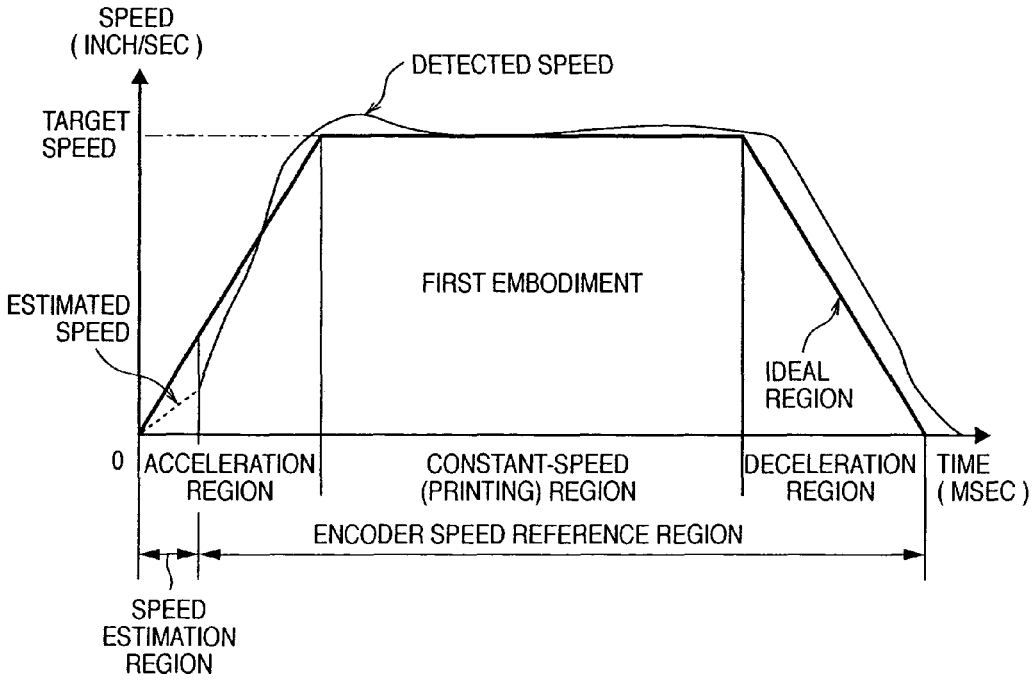
FIG. 9B is a graph showing the relationship between a target speed and a detected speed in the first embodiment.

FIG. 9A is a graph showing the relationship between a target speed and a detected speed in the prior art. FIG. 9B is a graph showing the relationship between a target speed and a detected speed in the first embodiment.

In the prior art shown in FIG. 9A, a speed higher than an actual carrier speed is detected for an ideal speed due to vibrations or the like immediately after activation of the carrier. As a result, follow-up to an ideal speed in acceleration degrades.

In the first embodiment shown in FIG. 9B, the speed is estimated at a predetermined ratio (about 1/2) of the ideal speed within α slits after the start of movement. In other words, the speed information is obtained by using the ideal speed, and its value is considered as the ideal speed. This ratio is determined while adjusting the PID control gain or the like such that the difference between an ideal speed and an estimated speed or a detected carrier speed outside the speed estimation region is made to fall within a predetermined range. Smooth acceleration in which the speed comes close to an ideal speed but does not greatly deviate from an actual speed can be realized.

According to the first embodiment, in servo-controlling the carrier 1 by using the DC motor on the basis of position information posStart300 obtained from the encoder sensor 45, not a detected speed obtained from the encoder, but the ideal speed spdMnp300 or an estimated speed calculated by multiplying the ideal speed spdMnp300 by a predetermined ratio (estimateStartPrm/etimeteStartPrmScal) is used as speed information for servo control of the carrier 1 during the carrier 1 moves in an arbitrary region (region corresponding to two to four slits) after the start of movement. The carrier 1 can be smoothly driven without any servo control disturbance caused by detection of an incorrect speed at the start of activating the carrier 1 or an error stop upon satisfying an error determination condition.

[Second Embodiment]

In the first embodiment, speed information used for servo control of the carrier is not a speed obtained from the encoder, but a target speed or a speed calculated by multiplying a target speed by a predetermined ratio until the carrier moves by several arbitrary slits after the carrier moves. The speed may be processed as 0 instead of estimating the speed from a target speed. The speed estimation value can be set to 0 by setting estimateStartPrm of the ratio (estimateStartPrm/etimeteStartPrmScal) in FIG. 8 to 0. This arrangement can provide strong acceleration upon activation, and the acceleration time and acceleration distance can be shortened though acceleration smoothness is slightly impaired.

[Third Embodiment]

In the first and second embodiments, speed information used for servo control of the carrier is not a speed obtained from the encoder, but a target speed or a speed calculated by multiplying a target speed by a predetermined ratio until the carrier moves by several arbitrary slits after the carrier moves. This ratio need not be constant and can be changed over time. For example, the ratio is set to the square of the time. This setting can achieve estimation in which the ratio is low immediately after the start of driving and high in the latter half of the estimation region.

[Fourth Embodiment]

In the first embodiment, speed information spdFed300 is calculated in S804 of FIG. 8 until the carrier moves in a distance corresponding to a predetermined number of slits. In this embodiment, previously calculated speed information is stored as a speed table in a memory, feed back control is performed by using speed information read from the table of the memory without referring to speed information detected by the encoder until the carrier moves in a predetermined distance after start of movement, and the feedback control is performed by using speed information detected by the encoder after the carrier moves in the predetermined distance. In this structure, if the memory area for storing the speed table can be secured sufficiently, a calculation time of the speed information can be omitted. There are a table having speed information corresponding to a movement amount of the carrier from start of movement and a table having speed information corresponding to progress time of the carrier after start of movement, as examples of the table.

In the above embodiments, droplets discharged from the printhead are ink, and a liquid contained in the ink tank is ink. The content of the ink tank is not limited to ink. For example, the ink tank may contain a processing solution to be discharged onto a printing medium in order to increase the fixing properties, water resistance, or quality of a printed image.

Of ink-jet printing systems, the embodiments can adopt a system which comprises a means (e.g., an electrothermal transducer or laser beam) for generating heat energy as energy utilized to discharge ink and changes the ink state by heat energy. This ink-jet printing system can increase the printing density and resolution.

As a representative arrangement or principle, the present invention preferably adopts the basic principle disclosed in, e.g., U.S. Pat. Nos. 4,723,129 or 4,740,796. This system is applicable to both a so-called on-demand apparatus and continuous apparatus. The system is particularly effective for the on-demand apparatus because of the following reason. That is, at least one driving signal which corresponds to printing information and gives a rapid temperature rise exceeding nuclear boiling is applied to an electrothermal transducer arranged in correspondence with a sheet or liquid channel holding a liquid (ink). This signal causes the electrothermal transducer to generate heat energy, and causes film boiling on the heat effecting surface of the printhead. Consequently, a bubble can be formed in the liquid (ink) in one-to-one correspondence with the driving signal. Growth and shrinkage of the bubble discharge the liquid (ink) from an orifice, forming at least one droplet. The driving signal more preferably has a pulse shape because a bubble grows and shrinks instantaneously at an appropriate timing to discharge the liquid (ink) with high response.

The pulse-like driving signal is preferably a signal disclosed in U.S. Pat. Nos. 4,463,359 or 4,345,262. Conditions disclosed in U.S. Pat. No. 4,313,124 which is an invention concerning the temperature rise ratio of the heat effecting surface can provide higher-quality printing.

The printhead structure can be a combination (linear liquid channel or right-angle liquid channel) of orifices, liquid channels, and electrothermal transducers as disclosed in each reference. The present invention also includes structures disclosed in U.S. Pat. Nos. 4,558,333 and 4,459,600 in which the heat effecting surface of an orifice heater is arranged in a bent region.

A full line type printhead having a length corresponding to the width of the largest printing medium printable by the printing apparatus can take a structure which meets this length by a combination of printheads as disclosed in the above-mentioned specifications, or a single integrated printhead structure.

It is also possible to employ a cartridge type printhead described in the embodiments in which an ink tank is integrated with a printhead itself, or an interchangeable chip type printhead which can be electrically connected to an apparatus main body and receive ink from the apparatus main body when attached to the apparatus main body.

It is preferable to add a printhead recovery means or preliminary means to the printing apparatus because printing operation can further stabilize. Practical examples of the additional means are a capping means for the printhead, a cleaning means, a pressurizing or suction means, an electrothermal transducer, another heating element, and a preliminary heating means as a combination of the electrothermal transducer and heating element. A predischarge mode in which discharge is performed independently of printing is also effective for stable printing.

The printing mode of the printing apparatus is not limited to a printing mode using only a main color such as black. The apparatus can adopt at least either a composite color mode using different colors or a full color mode using a color mixture, regardless of whether the printhead is an integral printhead or a combination of printheads.

The above-described embodiments assume that ink is a liquid. It is also possible to use ink which solidifies at room temperature or less and softens or liquefies at room temperature. A general inkjet system performs temperature control such that the viscosity of ink falls within a stable discharge range by adjusting the ink temperature within the range of 30° C. (inclusive) to 70° C. (inclusive). Hence, ink need only liquefy when a printing signal used is applied to it.

In order to prevent a temperature rise caused by heat energy by positively using the temperature rise as energy of the state change from the solid state to the liquid state of ink, or to prevent evaporation of ink, ink which solidifies when left to stand and liquefies when heated can be used. In any case, the present invention is applicable to any ink which liquefies only when heat energy is applied, such as ink which liquefies when applied with heat energy corresponding to a printing signal and is discharged as liquid ink, or ink which already starts to solidify when arriving at a printing medium. In the present invention, executing the aforementioned film boiling method is most effective for each ink described above.

Furthermore, the printing apparatus according to the present invention can take the form of any of an integrated or separate image output terminal of an information processing apparatus such as a computer, a copying apparatus combined with a reader or the like, and a facsimile apparatus having a transmission/reception function.

[Other Embodiment]

The present invention can be applied to a system constituted by a plurality of devices (e.g., a host computer, interface, reader, and printer) or to an apparatus (e.g., a copying machine or facsimile apparatus) comprising a single device.

The object of the present invention is also achieved when a storage medium (or recording medium) which stores software program codes for realizing the functions of the above-described embodiments is supplied to a system or apparatus, and the computer (or the CPU or MPU) of the system or apparatus reads out and executes the program codes stored in the storage medium. In this case, the program codes read out from the storage medium realize the functions of the above-described embodiments, and the storage medium which stores the program codes constitutes the present invention. The functions of the above-described embodiments are realized when the computer executes the readout program codes. Also, the functions of the above-described embodiments are realized when an OS (Operating System) or the like running on the computer performs part or all of actual processing on the basis of the instructions of the program codes.

The functions of the above-described embodiments are also realized when the program codes read out from the storage medium are written in the memory of a function expansion card inserted into the computer or the memory of a function expansion unit connected to the computer, and the CPU of the function expansion card or function expansion unit performs part or all of actual processing on the basis of the instructions of the program codes.

When the present invention is applied to the storage medium, the storage medium stores program codes corresponding to the processing steps (modules) of the flow charts shown in FIGS. 6 to 8 and various tables.

The present invention is not limited to the above embodiments and various changes and modifications can be made within the spirit and scope of the present invention. Therefore, to apprise the public of the scope of the present invention, the following claims are made.

What is claimed is:

1. An apparatus for controlling a printhead of a printing apparatus which prints by relatively moving the printhead across a printing medium, comprising:

control means for feedback-controlling a carrier supporting the printhead by using a predetermined speed and a predetermined position;

carrier position detection means for detecting carrier position information to be referred to by said control means;

carrier speed detection means for detecting carrier speed information to be referred to by said control means; and speed estimation means for calculating an estimated speed at a predetermined ratio by using the ideal speed referred to by said control means, wherein said control means does not refer to, as speed information used for the feedback control, the carrier speed information detected by said carrier speed detection means, and refers to the ideal speed or the estimated speed until the carrier moves by a predetermined amount after start of operation.

2. The apparatus according to claim 1, wherein said control means refers to the estimated speed as 0 until the carrier moves by a predetermined amount after start of operation.

3. The apparatus according to claim 1, wherein an independent value can be selected for each ideal speed as the predetermined ratio used for calculation by said speed estimation means.

4. The apparatus according to claim 3, wherein the predetermined ratio used for calculation by said speed estimation means is set to a value which makes a difference between the estimated speed or the carrier speed information and the ideal speed fall within a predetermined range.

5. The apparatus according to claim 1, wherein the predetermined ratio is 1 or less.

6. A method of controlling a printhead of a printing apparatus which prints by relatively moving the printhead across a printing medium, comprising:

a control step of feedback-controlling a carrier supporting the printhead by using a predetermined speed and a predetermined position;

a carrier position detection step of detecting carrier position information to be referred to in the control step;

a carrier speed detection step of detecting carrier speed information to be referred to in the control step; and a speed estimation step of calculating an estimated speed at a predetermined ratio by using the ideal speed referred to in the control step, wherein in said control step, the carrier speed information detected by said carrier speed detection step is not referred to, and the ideal speed or the estimated speed is referred to as speed used for the feedback control until the carrier moves a predetermined amount after start of operation.

7. The method according to claim 6, wherein said control step refers to the estimated speed as 0 until the carrier moves by a predetermined amount after start of operation.

8. The method according to claim 6, wherein in said control step an independent value can be selected for each ideal speed as the predetermined ratio used for calculation by said speed estimation means.

9. The method according to claim 8, wherein in said control step the predetermined ratio used for calculation by said speed estimation means is set to a value which makes a difference between the estimated speed or the carrier speed information and the predetermined speed fall within a predetermined range.

10. The method according to claim 6, wherein the predetermined ratio is 1 or less.

11. An apparatus for controlling a printhead of a printing apparatus which prints by relatively moving a carrier supporting the printhead across a printing medium, comprising:

encoder means for detecting carrier speed information and carrier position information;

control means for feedback controlling the carrier by using a predetermined speed profile; and storing means for storing speed information corresponding to moving amount of the carrier, wherein said control means feedback-controls the carrier by using the speed information stored in the storing means without referring to the speed information detected by the encoder means and with referring to a predetermined speed or an estimated speed until the carrier moves in a predetermined moving amount from the start of movement, and feedback-controls the carrier by using the speed information detected by the encoder means after the moving amount of the carrier becomes greater than the predetermined moving amount.

12. The apparatus according to claim 11, wherein said control means refers to the estimated speed as 0 until the carrier moves by a predetermined amount after start of operation.

13. The apparatus according to claim 12, wherein an independent value can be selected for each ideal speed as the predetermined ratio used for calculation by said speed estimation means.

14. The apparatus according to claim 13, wherein the predetermined ratio used for calculation by said speed estimation means is set to a value which makes a difference between the estimated speed or the carrier speed information and the predetermined speed fall within a predetermined range.

15. The apparatus according to claim 11, wherein the predetermined ratio is 1 or less.

* * * * *

UNITED STATES PATENT AND TRADEMARK OFFICE

CERTIFICATE OF CORRECTION

PATENT NO. : 7,168,783 B2
APPLICATION NO. : 10/645227
DATED : January 30, 2007
INVENTOR(S) : Hisatsugu Naito It is certified that error appears in the above-identified patent and that said Letters Patent is hereby corrected as shown below:

IN THE CLAIMS:

Column 11, claim 1, line 60, “ideal” should read --predetermined--.

Column 11, claim 1, line 65, “ideal” should read --predetermined--.

Column 12, claim 3, line 6, “ideal” should read --predetermined--.

Column 12, claim 4, line 13, “ideal” should read --predetermined--.

Column 12, claim 6, line 27, “ideal” should read --predetermined--.

Column 12, claim 6, line 31, “ideal” should read --predetermined--.

Column 12, claim 8, line 40, “ideal” should read --predetermined--.

Column 13, claim 13, line 9, “ideal” should read --predetermined--.

Signed and Sealed this

Thirty-first Day of July, 2007

JON W. DUDAS
*Director of the United States Patent and Trademark Office*